United States Patent [19]

Wilson

[11] 4,437,687

[45] Mar. 20, 1984

[54] WATERPROOF ASSEMBLY OR SEALING AN APERTURE HOUSING A CONDUIT

[76] Inventor: James H. Wilson, 7225 W. Marine Dr., Milwaukee, Wis. 53223

[21] Appl. No.: 209,376

[22] Filed: Nov. 24, 1980

[51] Int. Cl.[3] ..... E04B 5/48

[52] U.S. Cl. ..... 285/42; 285/44; 285/158; 285/424

[58] Field of Search ..... 285/42, 43, 44, 161, 285/192, 56, 58, 46, 422, 423, 158, 424; 52/199, 219

[56] References Cited

U.S. PATENT DOCUMENTS

| | | | |
|---|---|---|---|
| 1,062,015 | 5/1913 | Lane | 285/192 X |
| 1,153,282 | 9/1915 | Zahm | 285/161 X |
| 1,275,922 | 8/1918 | Holt | 285/42 |
| 1,391,396 | 9/1921 | McMurtrie . | |
| 1731617 | 10/1929 | Fleming . | |
| 2,088,410 | 7/1937 | Everson . | |
| 2,509,563 | 5/1950 | Grashow | 285/192 X |
| 2,657,703 | 11/1953 | Bletcher | 285/161 X |
| 2,985,291 | 5/1961 | Schoepe et al. | 285/161 X |
| 3,155,106 | 11/1964 | Boron | 285/46 X |
| 3,226,135 | 12/1965 | Epstein | 285/424 X |
| 3,276,021 | 9/1966 | Horndasch | 285/161 X |
| 3,749,424 | 7/1973 | Greene | 285/161 |
| 3,841,667 | 10/1974 | Sands | 285/192 X |
| 4,081,190 | 3/1978 | Itzler | 285/423 X |
| 4,306,738 | 12/1981 | Lindquist | 285/42 X |

FOREIGN PATENT DOCUMENTS 1305586 8/1962 France .

*Primary Examiner*—Dave W. Arola

[57] ABSTRACT

Disclosed is apparatus for providing an extension of a conduit through an aperture in a roof or a floor of a building and for providing a seal around the aperture, the apparatus including a conduit extension adapted to extend through the aperture in the roof. A first collar surrounds and is supported by the lower end of the conduit extension. The first collar includes a peripheral flange surrounding the aperture and being engageable against the roof. A second collar surrounds the upper end of the conduit extension, the second collar including a flange having a downwardly extending periphery. A resilient seal is located between the periphery of the second collar and the roof, and the periphery of the second collar is forced downwardly against the resilient seal for providing a seal between the collar and the roof.

3 Claims, 6 Drawing Figures

WATERPROOF ASSEMBLY OR SEALING AN APERTURE HOUSING A CONDUIT

FIELD OF THE INVENTION

The invention relates to an apparatus for use in providing seals around conduits such as plumbing pipes or heating conduits where the conduits or pipes pass through openings in the roof or floor of a building to thereby avoid the requirement for conventional flashing.

BACKGROUND PRIOR ART

In the construction of buildings, one problem that is commonly faced is the sealing around conduits such as heating and vent pipes, and plumbing conduits which extend upwardly through the roof or floors. In conventional construction practices, a waterproof flashing must be provided around such conduits and a sealant is poured or otherwise applied around the conduit and over the surface of a flashing to provide a waterproof seal between the flashing and the conduit and between the flashing and the roof. One of the problems with such construction practices is that they are labor intensive and expensive.

With reference to other sealing apparatus, attention is directed to the U.S. Lane Pat. No. 1,062,015, issued May 20, 1913; the U.S. Fleming Pat. No. 1,731,617, issued Oct. 15, 1929; and the U.S. McMurtrie Pat. No. 1,391,396. Attention is further directed to the U.S. Everson Pat. No. 2,088,410, issued July 27, 1937; the U.S. Sands Pat. No. 3,841,667, issued Oct. 15, 1974; and French Pat. 1,305,586.

SUMMARY OF THE INVENTION

The present invention provides improved means for forming a seal around a conduit extending through an aperture in a roof, floor or wall, the sealing apparatus being particularly adapted for use in the construction industry. The sealing means is intended to provide an improved seal and to decrease the costs of the installation of conduit such as plumbing and heating conduits which extend through the floors or roofs of buildings. For example, in one embodiment of the invention, the sealing means provides a seal around a conduit which extends through an aperture in a roof, and the conduit can include either metal or plastic plumbing pipes or heating conduits. The sealing means can also be used to provide a seal around any of these or other types of conduits extending through openings in flooring. For example, in cases of concrete floors in multiple floor buildings, it is desirable that the plumbing pipes extending through the floors be sealed so that water can not leak through the openings in the floor provided for the pipes.

More particularly, the invention includes apparatus for providing an extension of a conduit through an aperture in a structural member such as a roof, floor or wall and for providing a seal around the aperture. The apparatus comprises a conduit extension adapted to extend through the aperture in the structural member. A first collar surrounds and is supported by the lower end of the conduit extension, the first collar including a peripheral flange surrounding the aperture and being engageable against the structural member. A second collar surrounds the upper end of the conduit extension and includes a flange having a downwardly extending periphery. A resilient seal is located between the periphery of the second collar and the structural member, and means are further provided for forcing the periphery of the second collar downwardly against the resilient seal for providing a seal between the collar and the structural member.

In one embodiment of the invention the means for forcing the periphery of the second collar downwardly comprises a member threadably supported on the upper end of the conduit extension and engaging the second collar for forcing the second collar downwardly.

In one embodiment of the invention, the member threadably supported on the upper end of the conduit extension is integrally joined to the second collar.

In one embodiment of the invention, the conduit extension is a sheet metal tube having a lower end adapted to house an upper end of a sheet metal conduit, and the upper end of the sheet metal conduit extension includes external threads.

In one embodiment of the invention, the conduit extension is a plastic pipe and the lower end of the conduit extension includes socket means adapted to house an upper end of a plastic plumbing pipe.

The invention also includes apparatus for providing an extension of a conduit through an aperture in the floor of a building and for providing a seal around the aperture. The apparatus includes a conduit extension having upper and lower ends, the lower end being adapted to be connected to the conduit and the upper end including external threads. A member is connected to the lower end of the conduit extension and at least a portion of that member engages the floor. A collar surrounds the upper end of the conduit extension, the collar including a peripheral edge, and a resilient seal is adapted to surround the aperture and to be located between the peripheral edge and the floor. Means are also provided for forcing the peripheral edge of the collar against the resilient seal for providing a seal around the aperture, the means for forcing the collar against the resilient seal including a threaded member threadably supported on the threaded end of the conduit extension.

Various other features and advantages of the invention are set forth in the following description, in the drawings, and in the claims.

Figure 1:
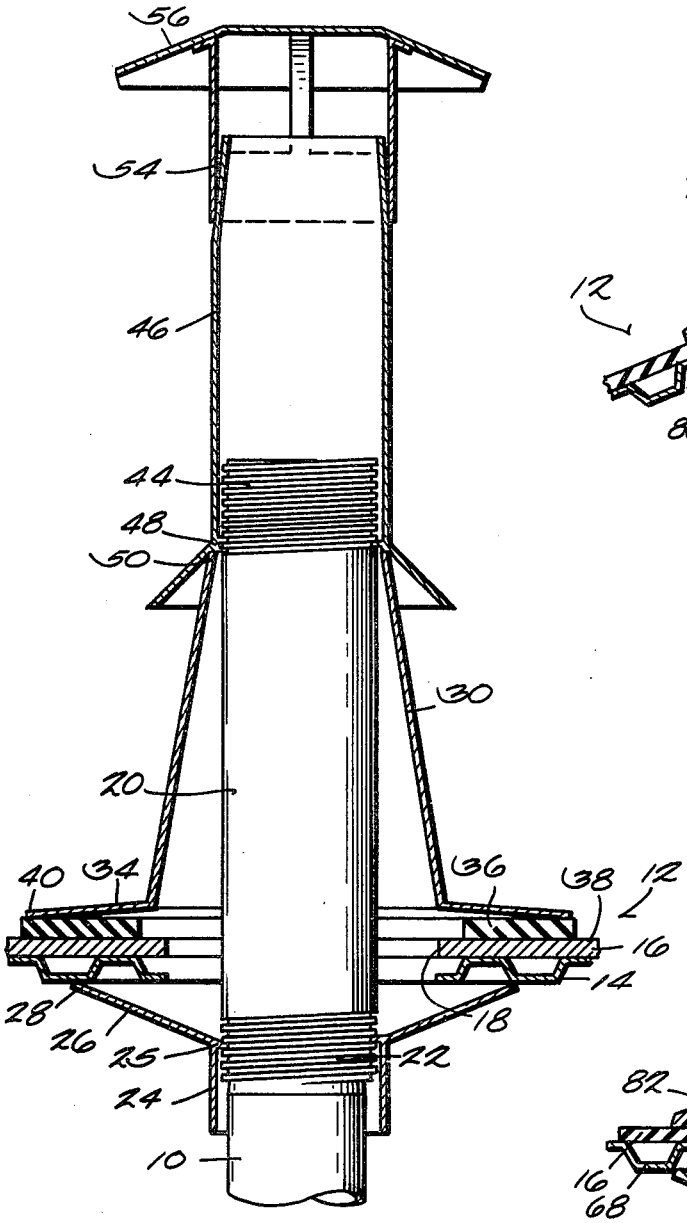
FIG. 1 is a cross section elevation view of apparatus embodying the invention.

Before describing some of the preferred embodiments of the invention in detail, it is to be understood that the invention is not limited in its application to the details of construction or to the arrangement of the specific components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is one embodiment of the apparatus of the invention for providing a seal around a conduit extension adapted to extend through an opening in a roof, the conduit extension being shown in that embodiment as comprising an extension of a stove pipe 10. In that construction, the roof 12 is comprised of a corrugated metal panel 14 covered by a deck 16, the deck 16 and metal panel 14 including an aperture 18 therethrough, the aperture 18 being adapted to permit extension of the stove pipe through the roof. The apparatus for providing the seal around the aperture includes a conduit extension member 20 which extends upwardly through the aperture 18 and includes a lower end surrounding the converging or tapered upper end of the stove pipe 10, the conduit extension member 20 being adapted to be forced downwardly onto the tapered upper end of the stove pipe 10. The external surface of the lower end 22 of the extension member 20 is threaded and is surrounded by a collar member 24. The collar member 24 includes an internal thread 25 for threadably engaging the lower threaded end 22 of the extension member and includes an outwardly and upwardly extending flange portion 26 including a peripheral edge 28 adapted to engage the lower surface of the roof 14, the flange 26 being constructed such that its lower surface is slightly convex.

The conduit extension member 20 extends upwardly through the aperture 18 and is surrounded by a generally conical collar 30. The lower end of the conical collar 30 includes an integral downwardly and outwardly extending flange 34, the flange 34 being constructed such that its upper surface is slightly convex. The conduit extension member 20 is also surrounded by a circular resilient seal 36 supported by the upper surface 38 of the deck 16 and surrounding the aperture or hole 18 in the roof. In the illustrated construction, the resilient seal 36 is comprised of a flat circular rubber or flexible plastic material adapted to be compressed in sealing relation against the upper surface 38 of the deck 16 by the outwardly extending peripheral edge 40 of the flange 34.

As illustrated in FIG. 1, the flange 34 slopes downardly and outwardly from the lower end of the collar 30 such that the peripheral edge 40 of the flange 34 engages the upper surface of the flexible or resilient seal 36.

Means are also provided for clamping the flange 34 of the conical collar 30 downwardly against the seal 36 and for similarly forcing the peripheral edge 28 of the lower collar member 26 upwardly against the lower surface of the roof 12. This means includes threads which are formed on the upper end 44 of the conduit extension member 20 and a sleeve 46 having a lower end portion 48 which threadably engages the threads on the upper end 44 of the conduit extension member 20. The lower end portion 48 of the sleeve 46 is adapted to abut the upper end 50 of the conical collar 30 and to force the conical collar 30 downwardly as the sleeve 46 is threaded onto the upper end 44 of the conduit extension member 20.

In the illustrated construction, the upper end 54 of the sleeve 46 is tapered so as to conveniently support a cap member 56 adapted to prevent mositure from entering the conduit.

As will be appreciated by those skilled in the art, by providing means for threadably forcing the conical collar 30 downwardly aganst the seal 36 a fluid tight seal can be formed around the aperture 18 in the roof to prevent any moisture from leaking through the aperture 18. Additionally, this is accomplished easily and without the application of conventional sealing materials such as tar or other fluid sealing substances.

Figure 2:
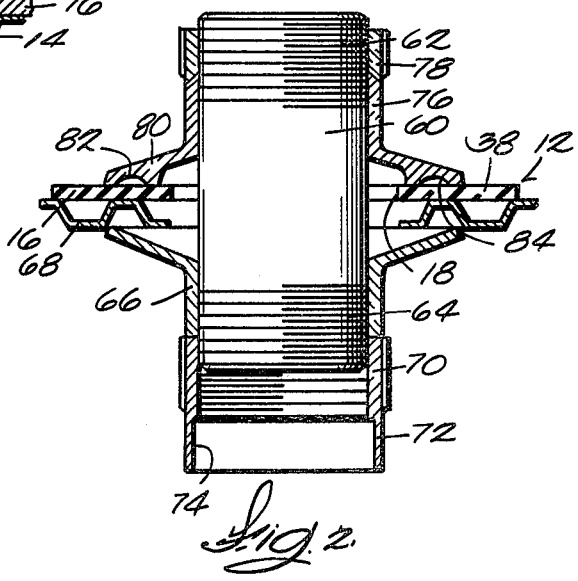
FIG. 2 is a cross section elevation view of apparatus comprising an alternative embodiment of the invention.

FIG. 2 illustrates an alternative embodiment of the invention, and more particularly a means for providing a seal around an aperture 18 adapted to house a plastic vent pipe 60. In the present state of the art, it is common to employ plastic pipe in plumbing applications, for example, vent pipes. In the construction illustrated in FIG. 2, a plastic pipe 62 is adapted to extend through the aperture 18 and having upper and lower threaded ends 62 and 64, respectively. A collar 66 is slideably supported on the lower end of the extension 60 and is adapted to engage the lower surface of roof 12. A threaded coupling 70 is threaded onto the lower end 64 of the extension 60 and abuts the collar 66. A lower portion 72 of the coupling 70 includes an internal socket 74 adapted to receive the upper end of a plastic vent pipe in sealing relation in a conventional manner. A second collar 76 is slideably supported on the upper end of the extension 60 and is forced downwardly against the upper surface 38 of the deck 16 by a threaded nut or collar 78. The lower portion 80 of the collar 76 is flared downwardly and outwardly so as to surround the aperture 18 and to engage the upper surface 38 of the deck 16. An O-ring seal 82 is held in a groove 84 and compressed between the flared portion 80 and the deck 16 to form a seal therebetween. The conduit extension 60 and each of the components 66, 70, 76 and 78 are comprised of the same materials conventionally used to make plastic pipe employed in the construction industry.

While the construction shown in FIG. 2 shows the collar 66 and the coupling 70 as separate pieces, it will be recognized that they could be formed as a single piece. Similarly, while collar 76 and the nut 78 are shown as separate pieces, they could also be constructed as a single piece.

Figure 3:
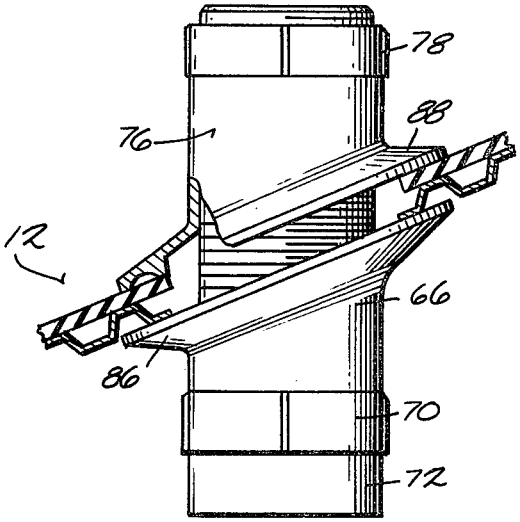
FIG. 3 is an elevation view of apparatus embodying another alternative embodiment of the invention.

FIG. 3 illustrates another alternative embodiment of the invention wherein the collars 66 and 76 of the arrangement shown in FIG. 2 are modified so as to be employed on an inclined roof. In the construction shown in FIG. 3, the collars 66 and 76 are each slideable on the conduit extension 60 but are provided with peripheral flanges 86 and 88, respectively, each having a slope complementary to that of the roof whereby their peripheral edges can be pressed against the roof 12 in sealing relation.

Figure 4:
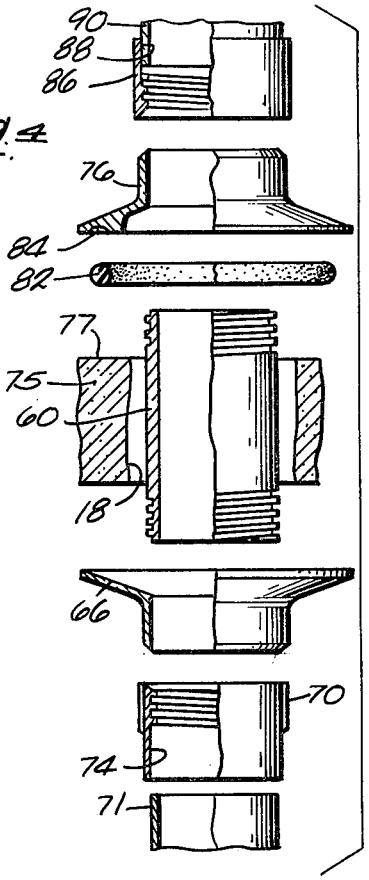
FIG. 4 is an exploded cross section view of apparatus embodying a further alternative embodiment of the invention.

FIG. 4 illustrates another alternative embodiment of the invention similar to that shown in FIG. 2, and wherein the sealing apparatus of the invention is illustrated as a means for providing a seal around a plastic conduit extension projecting through an opening in a concrete floor 75. As shown in FIG. 4, a plastic extension 60 having threaded upper and lower ends extends through an aperture 18 in the concrete floor. A flange 66 is forced against the lower surface of the floor by a collar 70. The collar 70 includes a socket 74 in its lower end for receiving the upper end of a plastic pipe 71. A flange 76 surrounds the upper end of the extension 60 and is forced against the upper surface 77 of the concrete floor 75 by a collar 86, the collar 86 being similar to collar 78 but further including a socket 88 in its upper end for housing the lower end of a pipe 90. An O-ring seal 82 is adapted to be housed in a recess 84 in the lower surface of flange 76 and is squeezed between the flange 76 and the upper surface 77 of the floor 75 to provide a fluid tight seal around the aperture 18.

Figure 5:
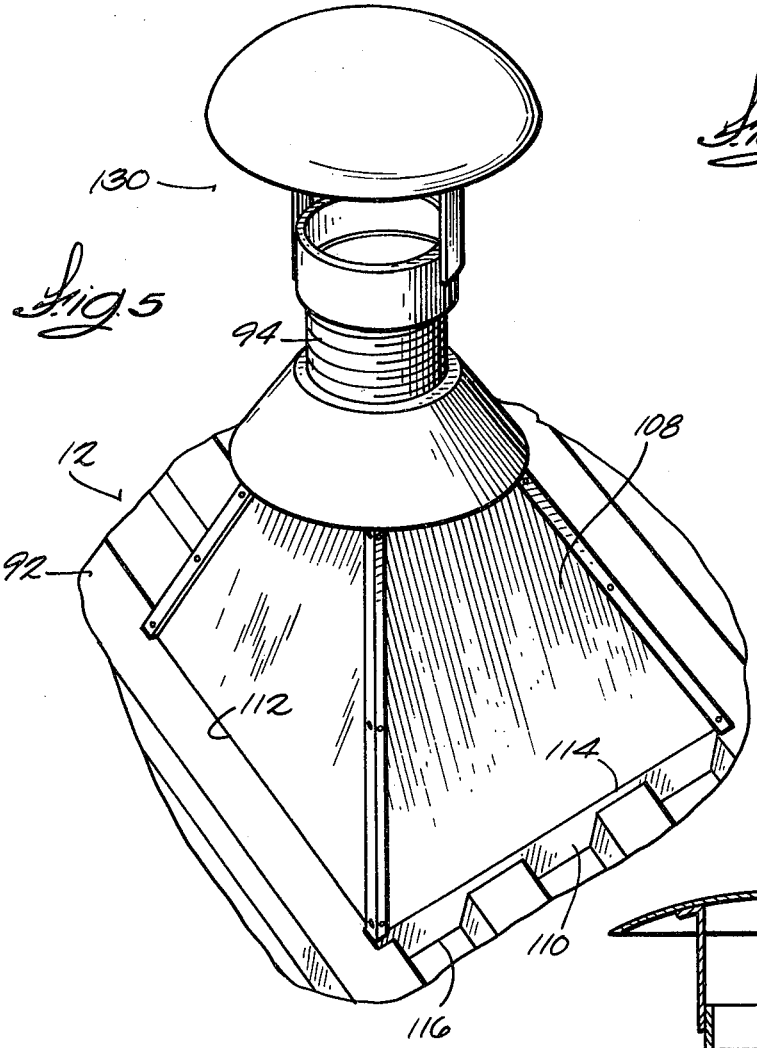
FIG. 5 is a perspective view of a further alternative embodiment of the invention.
Figure 6:
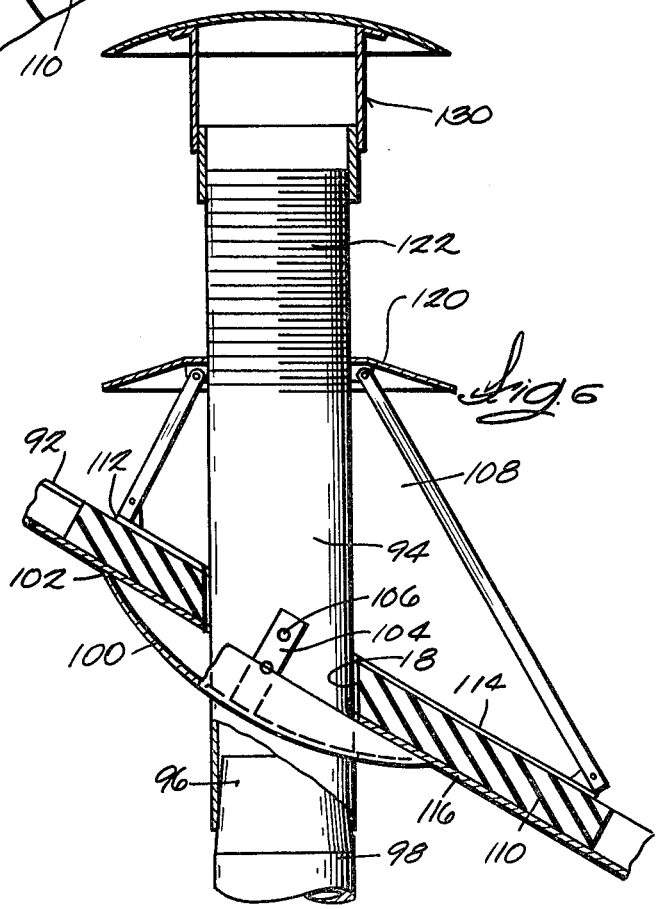
FIG. 6 is a partial cross section view of apparatus embodying another alternative embodiment of the invention.

FIGS. 5 and 6 illustrate an additional alternative embodiment of the invention similar to that shown in FIG. 1. In FIG. 5, the roof 12 is illustrated as having a corrugated upper surface 92. The roof 12 includes a central aperture 18 housing a stove pipe extensin 94, the lower end of the stove pipe extension 94 being adapted to be received over the tapered upper end 96 of a stove pipe 98. A dished circular flange 100 surrounds the extension 94 and includes a peripheral edge 102 adapted to engage the lower surface of the roof 12. The flange 100 is attached to the extension 94 by a pair of straps 104 (one shown) positioned on opposite sides of the extension 94 and pivotably connected thereto by pins 106. The upper end of the stove pipe extension 94 is surrounded by a flange 108 having a generally rectangular configuration in horizontal cross section and diverging from its upper portion downwardly and outwardly. A seal means 110 is housed between the lower edge 112 of the flange 108 and the corrugated roof 12. The seal 110 includes a planar upper surface 114 and a lower surface 116 which conforms to the corrugated surface of the roof 12. Means are also provided for forcing the flange 108 downwardly against the upper surface of the seal 110 to thereby insure a seal around the aperture 18. The forcing means comprises a cap 120 adapted to be threaded onto the threaded upper end 112 of the stove pipe extension 94, the cap 120 including an inner portion 124 adapted to engage the threads of the threaded upper end 122 and to bear against the upper end of the flange 108 to force the flange downwardly. The structure shown in FIGS. 5 and 6 also includes a shield or cover 130 positionable on the end of the stove pipe extension 94 and intended to prevent rain from entering the stove pipe.

From the foregoing it will be appreciated that the invention provides a very convenient and inexpensive means for forming a seal around a conduit extending through a floor, ceiling or roof. One of the principal advantages of the construction described is that it avoids the use of conventional flashing and the application of a fluid sealer or caulking material and thereby reduces the labor required in construction. Another advantage is that installation of the apparatus of the invention does not require skill or experience. On the other hand, when a fluid caulking or sealing material is used, care must be taken in its application to be sure that the seal is complete. Accordingly, it is necessary that it be performed by skilled or experienced personnel.

Various features of the invention are set forth in the following claims.

I claim:

1. Apparatus for providing an extension of an exhaust conduit of a building through an aperture in a wall of a building, the wall having an inner surface and an outer surface, and for providing a seal around the aperture to prevent access of moisture into the aperture, said apparatus comprising an exhaust conduit extension adapted to be connected to one end of an exhaust conduit of a building and adapted to extend through the aperture in the wall for providing a continuation of the exhaust conduit through the aperture, said exhaust conduit extension being comprised of sheet metal and having opposite ends, said opposite ends each including a threaded external surface, a restraining member threaded onto one end of said conduit extension, said restraining member being adapted to engage said inner surface of said wall on opposite sides of said aperture to prevent said conduit extension from being drawn through said aperture, a collar surrounding the other end of said conduit extension, said collar including a flange having a periphery, a resilient seal between said periphery of said collar and said outer surface of said wall, said resilient seal comprising a disc including a planar surface, and means for forcing said periphery of said collar against said planar surface of said resilient seal so as to compress said resilient seal against said outer surface of the wall and for providing a fluid tight seal between said collar and said outer surface of said wall, said means for forcing said periphery of said collar against said resilient seal including an annular member threadably supported on said other end of said conduit extension and engaging said collar for forcing said collar against said resilient seal and for causing said resilient seal to be compressed between said collar and said outer surface.

2. Apparatus for providing an extension of an exhaust conduit of a building through an aperture in a roof of a building, the roof having upper and lower surfaces, and for providing a seal around the aperture and between the exhaust conduit and the upper surface of the roof to prevent access of moisture into the aperture, said apparatus comprising an exhaust conduit extension having upper and lower ends, said upper and lower ends each including external threads, said conduit extension being comprised of sheet metal and being adapted to extend through the aperture, and said lower end of said conduit extension being adapted to be connected to said exhaust conduit of the building and for providing and extension of the exhaust conduit, through the aperture in the roof, a restraining member threaded onto said lower end of said conduit extension, at least a portion of said restraining member engaging said lower surface of the roof, a collar surrounding the upper end of said conduit extension, said collar including a peripheral edge, a resilient seal adapted to surround said aperture and to be located between said peripheral edge of said collar and the upper surface of the roof, said resilient seal comprising a disc including a planar surface, and means for forcing said peripheral edge of said collar against said planar surface of said resilient seal for providing a seal around said aperture, said means for forcing said collar against said resilient seal including a threaded member threadably supported on said upper end of said conduit extension and adapted to force said collar against said resilient seal and to force said resilient seal against the roof when said threaded member is threaded onto said upper end of said conduit extension.

3. Apparatus for providing an extension of an exhaust conduit of a building through an aperture in the floor of a building, the floor having an upper surface and a lower surface and for providing a moisture tight seal around the aperture to prevent access of moisture into the aperture, said apparatus comprising an exhaust conduit extension having upper and lower ends, said upper and lower ends each including external threads, said conduit extension being comprised of sheet metal and being adapted to extend through said aperture, and said conduit extension including one end adapted to be connected to said exhaust conduit and for providing an extension of said exhaust conduit through said aperture, a restraining member threaded onto the lower end of said conduit extension, at least a portion of said restraining member engaging said lower surface of said floor, a collar surrounding the upper end of said conduit, said collar including a peripheral edge, a resilient seal adapted to surround said aperture and to be located between said peripheral edge of said collar and said floor, said resilient seal comprising a disc including a planar surface, and means for forcing said peripheral edge of said collar downwardly against said resilient seal for providing a seal around said aperture, said means forcing said collar against said resilient seal including a threaded member threadably supported on said upper end of said conduit extension and adapted to force said collar against said resilient seal and to force said resilient seal against the floor when said threaded member is threaded onto the upper end of said conduit extension.

* * * * *